US005125707A

United States Patent [19]

Chaen et al.

[11] Patent Number: 5,125,707

[45] Date of Patent: Jun. 30, 1992

[54] ROTARY LOAD LIFTING HOOK DEVICE

[75] Inventors: Yoshinobu Chaen; Kazuhide Kameyama, both of Kawachinagano, Japan

[73] Assignee: Sankyu Inc., Kitakyushu, Japan

[21] Appl. No.: 635,640

[22] PCT Filed: May 14, 1990

[86] PCT No.: PCT/JP90/00606

§ 371 Date: Jan. 16, 1991

§ 102(e) Date: Jan. 16, 1991

[87] PCT Pub. No.: WO90/14300

PCT Pub. Date: Nov. 29, 1990

[30] Foreign Application Priority Data

May 17, 1989 [JP] Japan ..... 1-57278[U]
Oct. 17, 1989 [JP] Japan ..... 1-122050[U]

[51] Int. Cl.[5] ..... B66C 1/34
[52] U.S. Cl. ..... 294/82.15
[58] Field of Search ..... 294/82.15, 67.5, 81.4, 294/82.12, 86.41; 74/665 GE, 397

[56] References Cited

U.S. PATENT DOCUMENTS

| | | | |
|---|---|---|---|
| 1,577,283 | 3/1926 | Mitchell | 294/82.15 |
| 2,823,944 | 2/1958 | Anderson et al. | 294/82.15 |
| 3,009,728 | 11/1961 | Breslav | 294/82.15 |
| 3,046,046 | 7/1962 | Gris | 294/82.15 |
| 3,527,495 | 9/1970 | Maradyn | 294/86.41 X |
| 3,902,614 | 9/1975 | Roberts et al. | 294/86.41 X |
| 4,451,194 | 5/1984 | Keats et al. | 294/86.41 X |
| 4,466,768 | 8/1984 | Datseris et al. | 294/86.41 X |
| 4,514,135 | 4/1985 | Cade et al. | 294/86.41 X |

FOREIGN PATENT DOCUMENTS

| | | |
|---|---|---|
| 59-88083 | 6/1981 | Japan . |
| 56-141288 | 11/1981 | Japan . |

*Primary Examiner*—Margaret A. Focarino
*Assistant Examiner*—Dean J. Kramer
*Attorney, Agent, or Firm*—Armstrong & Kubovcik

[57] ABSTRACT

A rotary load lifting hook device according to the present invention incorporates a remotely operable rotational driving device 11 provided on a hook block 20 on which a load lifting hook 1 is positioned vertically for rotation. The rotational driving device 11 and the hook block 20 are connected to each other by means of chain wheels 12, 13 provided respectively thereon. An endless chain 14 is held in meshing engagement with the chain wheels 12, 13 so that the hook block 20 may be driven to rotate by remote operation. Rocking motion, oscillations and so forth which take place with the load lifting hook 1 when a load is lifted may be absorbed by the endless chain 14 such that the load lifting hook 1 can be rotated with safety and with cetainty without causing overstrain with the rotational driving device 11 and the load lifting hook 1.

3 Claims, 3 Drawing Sheets

Fig.5
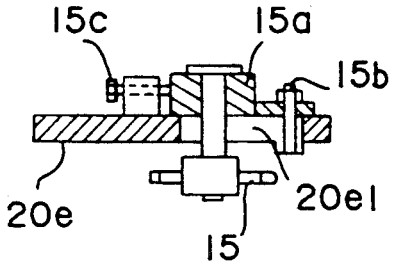
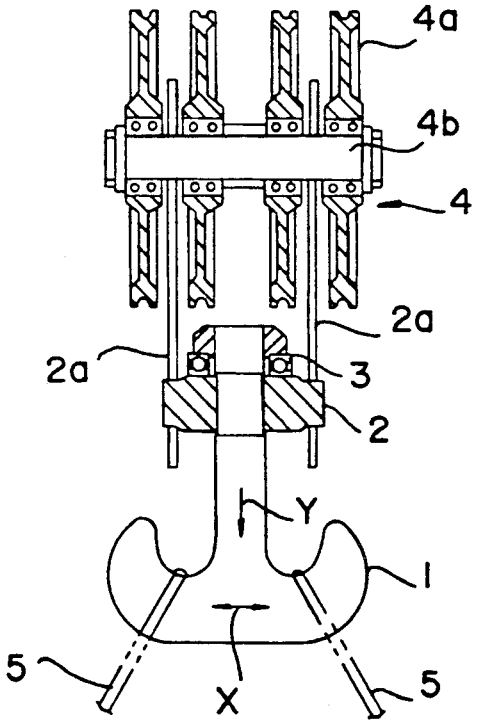
Fig.6
PRIOR ART

ROTARY LOAD LIFTING HOOK DEVICE

DESCRIPTION

1. Technical Field

This invention relates to improvements in or relating to a load lifting hook device, and particularly to a hook device wherein a load lifting hook is constructed such that it can be rotated by remote operation so as to perform an efficient load lifting operation.

2. Background Art

FIG. 6 is a sectional structural view showing an example of a hook device for a well known conventional load lifting apparatus. In the figure, reference numeral 1 denotes a load lifting hook (hereinafter referred to only as hook), and 2 a hook block on which the hook 1 is supported vertically for rotation using; for example, a thrust bearing 3. The hook block 2 is held by holding frames 2*a* on a shaft 4*b* on which sheave wheels 4*a* are normally supported for rotation. Then, the hook block 2 is constructed wherein the hook 1 is positioned vertically for rotation thereon as described above. The hook block 2 is moved up or down following a sheave block 4 which is formed by the sheave wheels 4*a* and the shaft 4*b*. Wire ropes 5 slung to a load to be lifted are engaged with the hook 1, and the load is lifted by winding up the sheave block 4 so that transportation to a predetermined location can be performed.

By the way, the necessity for changing the direction of a lifted load during such a transporting process often arises. Further, it is necessary to finely control the direction of a lifted load also when it is to be placed down with a predetermined piece of equipment or to a particular site. Further, provision of a jig (hereinafter referred to as a lifting jig) of the exclusive use for performing such slinging as described above automatically, in short, only by an operator of a crane without requiring a slinging operator has only been attempted in recent years. When using such a lifting jig, it is necessary to control the direction of the jig in accordance with the load to be lifted. While such a direction control is possible by rotating the hook 1, conventionally, it is a common practice that the rotation operation is performed manually by an operator of the load to be lifted or the lifting jig. Consequently, having of an operator for such a rotating operation is inevitable, and no power saving can be achieved particularly even by provision of the lifting jig or the like.

In addition, means for automatically rotating the hook 1 to solve the problems described above have been conventionally proposed, for example, in the official gazette of Japanese Patent Laid-Open Application No. 141288/1981, the official gazette of Japanese Utility Model Laid-Open Application No. 88083/1984. and so forth. In particular, the means of the official gazette of Japanese Patent Laid-Open Application No. 141288/1981 includes a small gear directly coupled to a motor which is disposed on a hook block described above while a large gear is provided on a hook such that the hook may be rotated by rotating the motor. Similarly, the means of the official gazette of Japanese Utility Model Laid-Open Application No. 88083/1984 incorporates a hook that is rotated by a well known combination of a worm and a worm wheel.

However, such means which employ a gear have such problems as described below constitute serious obstacle to putting such devices into pratical use. In particular, such problems that include the hook rocking as a result of impact or oscillations when a load is lifted or of oscillations or the like from a lifting apparatus in a load-free condition wherein no load is lifted. Against such rocking motion, movement of the hook block in a vertical (thrust) direction y is naturally restrained by a thrust bearing as described hereinabove. However, a structure is normally employed which permits some movement in a radial direction x. Where such a structure is employed, economical designing is enabled which does not make the hook block or hook or some other hook supporting members greater than necessary. However, where a rotary device which employs a gear as described above is adopted for a hook block of such a structure, the meshing engagement between a small gear and a large gear or between a worm and a worm wheel being cancelled by movement of the hook in a radial direction x or their being engaged excessively deep with each other so as to cause break of teeth often occur. Accordingly, it is necessary also to restrain movement of the hook in a radial direction x in the hook block. Further, providing a radial bearing or increasing components of the hook block and so forth in size also becomes necessary. As a result, the hook block is large in size and is complicated in structure. Such complications result further in losses in lifting stroke capacity.

It is an object of the present invention to achieve drastic solutions to the problems of the conventional rotary devices described above and to provide a rotary hook device which enables highly accurate control of rotation with a simple construction.

SUMMARY OF INVENTION

In order to solve the problems of conventional devices, according to the present invention, a rotary load lifting hook device (hereinafter referred to only as hook device) is characterized in that a remotely operable rotational driving device having a driving chain wheel at a lower end thereof is provided uprightly on and secured to a hook block on which a load lifting hook is provided vertically for rotation such that the driving chain wheel may be located below a set location of the hook block while a driven chain wheel is fitted on an outer periphery of the hook at the same level as the driving chain wheel. An endless chain is stretched between the driving chain wheel and the driven chain wheel. With that construction, since rocking motion which takes place when a load is lifted or the like is absorbed by the endless wheels, a turning force can be transmitted smoothly from the rotational driving device to the hook.

It is possible to construct the hook device such that the rotational driving device is a geared motor and a frequency converter is interposed in a power source supply system to the rotational driving device. With that construction, the entire device can be reduced in size, and further, it is possible to reduce the reducing gear ratio of the geared motor (toward a ratio of 1).

Then, it is also possible to construct the hook device such that a follower chain wheel is disposed at a location of the hook block opposite to the driving chain wheel with respect to the driven chain wheel, and the endless belt is stretched between the driving chain wheel and the follower chain wheel across the driven chain wheel. With this construction, a radial load to be applied to the hook by tension of the endless belt upon driving can be reduced.

Further, in the rotary load lifting hook according to the present invention, preferably the diameter of the driven chain wheel is constructed larger than those of the driving chain wheel and follower chain wheel. Further, it is also possible to mount the follower chain wheel for movement on the hook block. With this construction, even if the endless belt is elongated, adjustment of the same can be performed, and rotation can be transmitted smoothly to the hook.

BRIEF DESCRIPTION OF DRAWINGS

FIG. 5 is a partial sectional view showing an embodiment a follower chain wheel mounted for movement; and FIG. 6 is a sectional structural view showing an example of a hook device in a well known conventional load lifting apparatus.

BEST MODE FOR CARRYING OUT THE INVENTION

Figure 1:
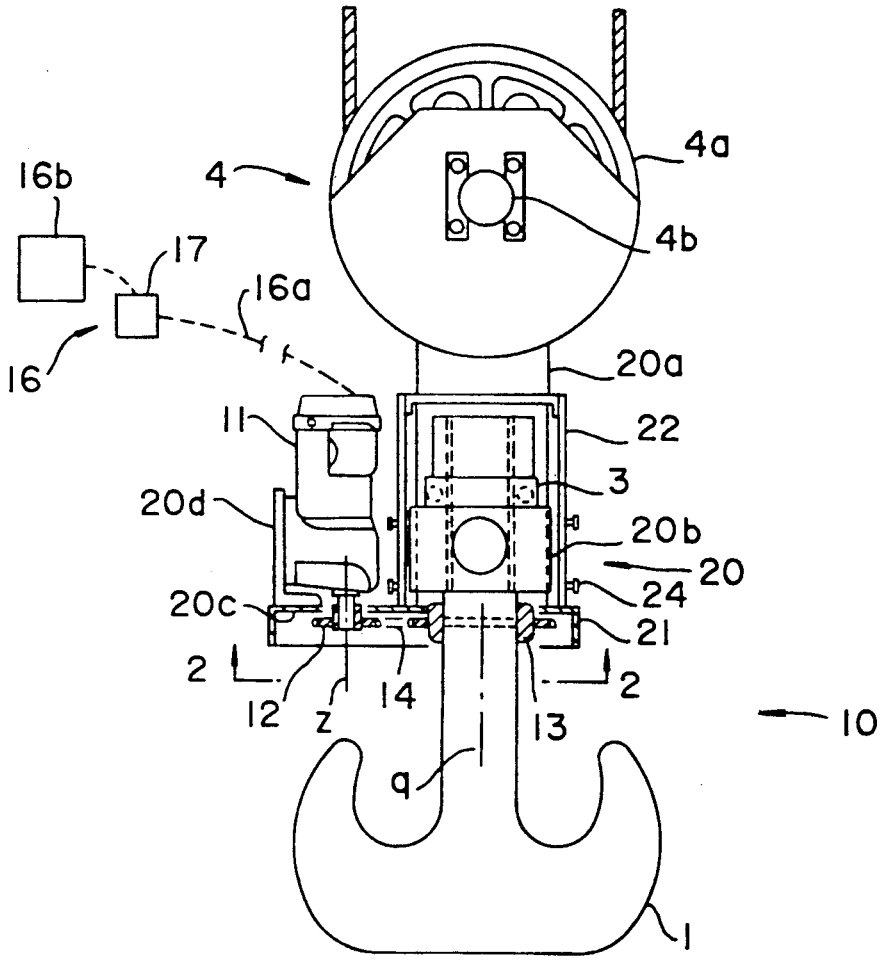
FIG. 1 is a side elevational structural view showing an embodiment of a hook device in accordance with the present invention.
Figure 2:
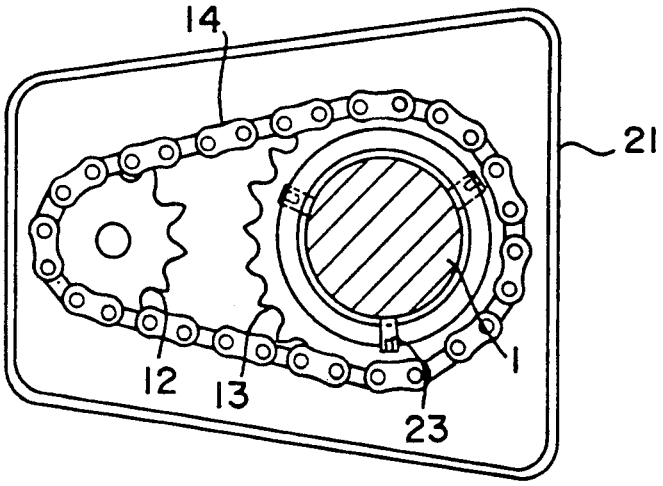
FIG. 2 is a sectional view taken along line A—A of FIG. 1.

FIG. 1 is a side elevational structural view showing an embodiment of a hook device 10 in accordance with the present invention, and FIG. 2 is a sectional view taken along line A—A of FIG. 1. Referring to FIGS. 1 and 2, reference 20 denotes a hook block on which a hook 1 is provided vertically for rotation, and a rotational driving device 11 is provided uprightly on and secured to the hook block 20. The hook block 20 in the present embodiment is constructed from a block body **20*b* on which the hook 1 is provided vertically by way of a thrust bearing 3 or the like, a holding frame 20*a* by which the block body 20*b* is connected to a sheave block 4, and a holding frame 20*c* securely mounted on and held at a lower end of the holding frame 20*a* and provided to project from the block body 20*b* for supporting the rotational driving device 11 thereon. The rotational driving device 11 has a driving chain wheel 12 at a lower end thereof and is provided uprightly on and secured to the supporting frame 20*c* such that the driving chain wheel 12 may be located below a set location of the hook block 20. In particular, the rotational driving device 11 is provided uprightly such that an axis z of the driving chain wheel 12 extends in parallel to an axis q of the hook 1 and is secured to the support frame 20*c* by way of a bracket 20*d* such that the driving chain wheel 12 may be located below a set location described below of the hook block 20. The rotational driving device 11 can employ, for example, an electrically driven speed reducer, an air motor or the like which has a suitable speed reducing ratio at which the driving chain wheel 12 is rotated at a predetermined rotational speed and besides can be remotely operated from an operating location such as a crane cage or a pendant switch or the like. A driven chain wheel 13 is fitted on an outer periphery of the hook 1 located at the same level as the driving chain wheel 12, and an endless chain 14 is stretched between the driven chain wheel 13 and the driving chain wheel 12**.

Thus, by driving the rotational driving device 11 to rotate, the driving chain wheel 12 is rotated, and turning force of the driving chain wheel 12 is transmitted to the driven chain wheel 13 through the endless chain 14 to rotate the hook 1. As described so far, the hook device 10 of the present invention is characterized in that turning force of the driving chain wheel 12 is transmitted through the endless chain 14 to the driven chain wheel 13 fitted on the outer periphery of the rotatable hook 1 so as to rotate the hook 1. Even if movement of the hook 1 in a radial direction x takes place, that movement is effectively absorbed by the flexibility of the endless belt 14 so that the hook 1 can be driven to rotate with certainty. Thus, it is necessary that the locations of the driving chain wheel 12 and driven chain wheel 13 be spaced by a small amount from and lower than a lowermost face of the hook block 20 so that the hook 1 can be rotated smoothly without the driving chain wheel 12 and driven chain wheel 13, or the stretched endless chain 14 contacting with the hook block 20. In the present invention, "below a set location" of the hook block is used with such a meaning.

It is to be noted that, in FIGS. 1 and 2, reference numeral 21 denotes a protective cover which surrounds the driving and driven chain wheels 12 and 13, respectively and the endless chain 14. Reference numeral 22 denotes another protective cover which surrounds an upper portion of the hook 1 while 23 denotes a fastening screw for securing the driven chain wheel 13 to an outer periphery of the hook. Reference numeral 24 denotes another fastening screw for securing the protective cover 22 to the block body **20*b***.

If the rotational driving device 11 is constructed such that a geared motor is employed therefor and a frequency converter 17 is interposed in a power source supply system 16 to the rotational driving mechanism 11 which is formed from a cable **16*a*, a control board 16*b* and so forth as shown in FIG. 1, then the rotational driving device 11 can be made comparatively small in size and the reducing gear ratio can be selected freely in a wide range. As a result, superior effects as described below are obtained. In particular, where the rotational driving device 11 is constructed only from a normal speed reducing gear, if the reducing gear ratio is increased, then the speed reducing gear is naturally increased in size. This leads to a fatal defect in that the hook block has to be increased in size and the loss in a lifting stroke takes place significantly as described hereinabove. In addition, if minor position control or adjustments of a load to be lifted is required, the hook 1** cannot be rotated manually by a man resulting in a significant restriction in operability.

However, where the frequency converter 17 is interposed in the power source supply system 16 to convert a frequency, it is possible to maintain a high total reducing gear ratio without increasing the reducing gear ratio of the gear motor having an ac, motor such as an induction motor, inside thereof beyond what is necessary. Table 1 illustrates an example of the relationship of the total reducing gear ratio which is determined from ratios in number of teeth between the frequency converter 17 and the geared motor, and between the driving chain wheel and the driven chain wheel. For example, when the rotational speed of the motor is 1.800 rpm, while the reducing gear ratio of the geared motor in the example of No. 5 is 1/200, the rotational speed of a final shaft can be reduced to 0.9 rpm by converting the frequency to 1/5, and the hook 1 on which a load is lifted can be rotated efficiently and with safety at an optimum speed.

TABLE 1

| No | 1 | 2 | 3 | 4 | 5 |
|---|---|---|---|---|---|
| Frequency Converter | 1/1 | 1/2 | 1/3 | 1/4 | 1/5 |
| Geared Motor | $\frac{1}{1200}$ | $\frac{1}{600}$ | $\frac{1}{400}$ | $\frac{1}{300}$ | $\frac{1}{200}$ |
| Chain Wheel Tooth Number Ratio | 1/2 | 1/2 | 1/2 | 1/2 | 1/2 |
| Total Reducing Gear Ratio | $\frac{1}{2400}$ | $\frac{1}{2400}$ | $\frac{1}{2400}$ | $\frac{1}{2400}$ | $\frac{1}{2400}$ |

Further, where the reducing gear ratio of the geared motor is 1/200 or so, the hook 1 can be rotated readily by an operator manually, and operational efficiency can be improved remarkably. In addition, even when a one-sided excessive load acts upon the hook 1, the hook 1 rotates automatically to a stabilized position. Thus, no excessive force acts upon the driven chain wheel 13, hook block 20 or the like.

Figure 3:
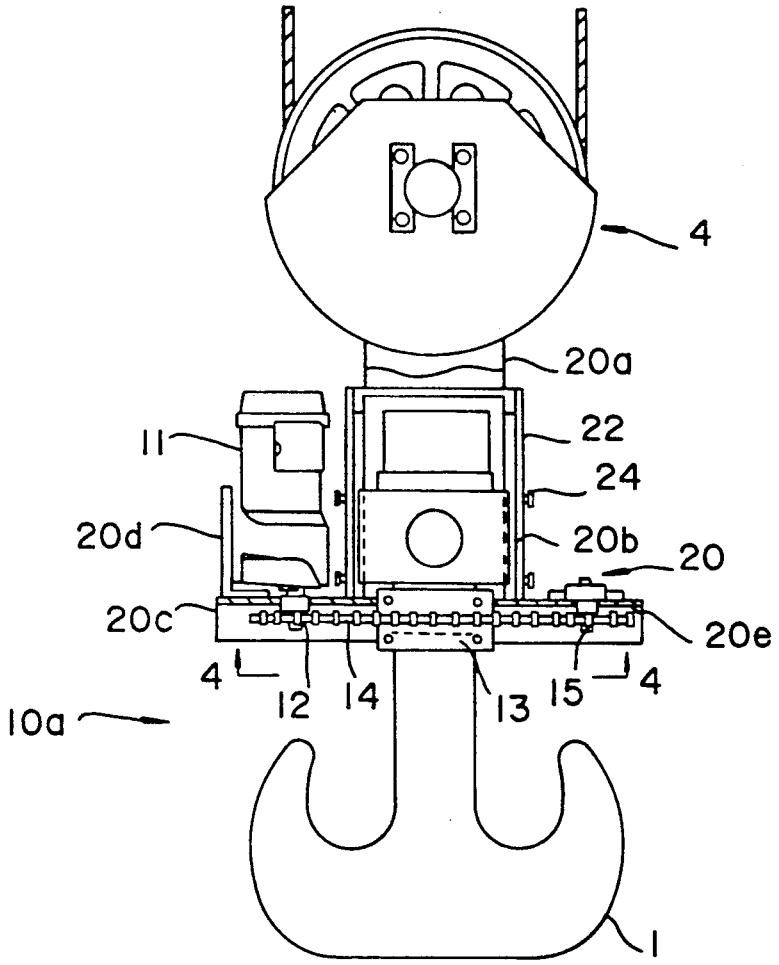
FIG. 3 is a side elevational view showing another embodiment of a hook device in accordance with the present invention.
Figure 4:
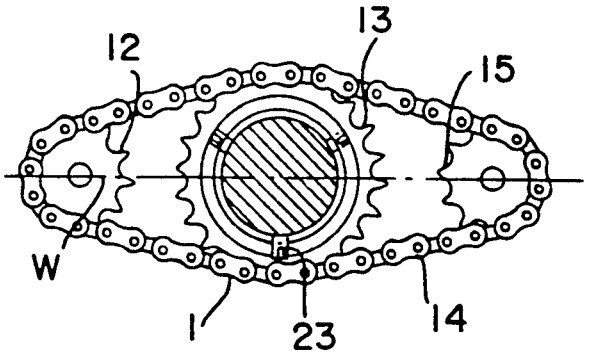
FIG. 4 is a sectional view taken along line B—B of FIG. 3.

FIG. 3 is a side elevational view showing an embodiment of a hook device 10*a* in accordance with claims 3 and 4 of the present invention, and FIG. 4 is a sectional view taken along line B—B of FIG. 3. In the present embodiment, a supporting frame 20*e* is provided in the opposite direction of an aforementioned hook block 20 across a block body 20*b*, and a follower chain wheel 15 is disposed on the supporting frame 20*e* at the same level as an aforementioned driving chain wheel 12. In short, the driving chain wheel 12 and the driven chain wheel 15 are disposed at symmetrical locations with respect to a driven chain wheel 13 fitted on an outer periphery of a hook 1. Between the chain wheels, (between the driving chain wheel 12 and follower chain wheel 15) an endless chain 14 is stretched such that it holds the driven chain wheel 13 therebetween. Thus, if a rotational driving device 11 is driven to rotate so that the driving chain wheel 12 is rotated, the endless chain 14 is circulated in an endless fashion between the driving chain wheel 12 and follower chain wheel 15 to rotate the driven chain wheel 13 held in meshing engagement with the endless chain 14 so that the hook 1 can be rotated. In the present hook device 10*a*, since the endless chain 14 is stretched in a taut condition between the driving chain wheel 12 and follower chain wheel 15, a greater amount of movement of the hook 1 in a radial direction x can be permitted. Particularly, where the driven chain wheel 13 is constructed greater in diameter than the driving chain wheel 12 and follower chain wheel 15 as shown in FIG. 4, then it is possible to restrain the aforementioned movement of the hook 1 in a radial direction by tension of the endless chain 14 and reduce the radial load acting upon the block body 20*b*. Such an effect is particularly significant with a simplified load lifting apparatus or the like wherein rotation of the hook 1 in a load-free condition described hereinabove or with only the weight of the hook 1 itself, the weight of a load to be lifted and so forth are comparatively light.

According to the experience of the inventors, the function described above could have been exhibited sufficiently where the ratio ($D_2/D_1$) between the diameter $D_1$ of the driving chain wheel 12 and follower chain wheel 15 with the diameter $D_2$ of the driven chain wheel 13 was greater than 2. Further, if the follower chain wheel 15 is mounted for movement on the hook block 20, then replacement of the endless chain 14 can be performed very readily, which is effective. It is to be noted that it is a matter of course that, also in the present embodiment, the rotational driving device 11 may be constructed such that a gear motor is employed therefor and a frequency converter 17 is interposed in a power source supply system 16 to the rotational driving device 11. Further, it is also possible to connect the rotational driving device 11 to the follower chain wheel 15 so as to employ a two driving system, and any construction may be adopted suitably in accordance with the necessity.

FIG. 5 show an embodiment of a follower chain wheel 15 mounted for movement, and in the present embodiment, a mounting through-hole 20$e_1$ in the form of an elongated hole is formed in a supporting frame 20*e* of a hook block 20. A fastening bolt 15*b* is inserted in the mounting through-hole 20$e_1$ such that a bearing member 15*a* on which the driven chain wheel 15 is supported for rotation is secured by means of the fastening bolt 15*b* while an adjusting bolt 15*c* is provided in a tensioning direction of an endless chain 14. Naturally, the present invention is not limited to the present embodiment, and any structure wherein the follower chain wheel 15 can be moved freely in a direction of an arrangement axis w shown in FIG. 4 can be designed and adopted.

A hook device of the present invention is constructed such that a remotely operable rotational driving device having a driving chain wheel at a lower end thereof is provided upright on and secured to a hook block on which a hook is provided vertical for rotation such that the driving chain wheel may be located below a set location of the hook block while a driven chain wheel is fitted on an outer periphery of the hook at the same level as the driving chain wheel; a follower chain wheel is disposed in addition to the driven chain wheel and an endless chain is stretched between those wheels. While the hook device is simple in construction, it has such various effects as described below:

(1) Making use of the flexibility of the endless belt effectively, even in a condition wherein the hook is rocked, the hook can be rotated with certainty and with safety; also, accurate direction control of a load to be lifted or a lifting jig is possible.

(2) Particularly where the diameter of the driven chain wheel is made greater than those of the driving chain wheel and follower chain wheel, it is possible to restrain movement of the hook in a radial direction and reduce the radial load acting on the block body. As a result, it is possible to reduce the block body in size and to have highly accurate rotation control in a load-free condition.

(3) Since the construction is simple, the production cost is low, replacement or adjustment in elongation of the endless chain can be performed readily, and the ease in maintenance is superior.

(4) The hook device can be adopted readily for an existing hook device and can increase the range of its application remarkably.

(5) Since the reducing gear ratio of the rotational driving device can be made low, the device can be simplified and reduced in size. Also, having operator able to manually rotate the hook, operability can be improved remarkably.

We claim:

1. A rotary load lifting hook device, comprising:

a remotely operable rotational driving device;

a hook block, said driving device being positioned upright on a top surface of said hook block;

a load lifting hook vertically mounted on a bottom surface of said hook block for rotation such that a driving chain wheel is operatively connected to said hook and located below said hook block;

a driving chain wheel connected to said driving device and located at a lower end of said driving device;

a driven chain wheel fitted on an outer periphery of said hook at a same level as said driving chain wheel;

an endless chain; and a follower chain wheel disposed opposite to said driving chain wheel with respect to said driven chain wheel on said hook block, wherein said endless belt is stretched and operatively connected between said driving chain wheel and said follower chain wheel across said driven chain wheel, said follower chain wheel including movable mounting means on said hook block, for adjustable tensioning of said endless chain between said driving chain wheel and said follower chain wheel across said driven chain wheel.

2. A rotary load lifting hook device according to claim 1, wherein said rotational driving device further includes a geared motor, and a frequency converter interposed in a power source supply system to said rotational driving device.

3. A rotary load lifting hook device according to claim 1, wherein a diameter of said driven chain wheel is constructed larger than diameters of said driving chain wheel and follower chain wheel.

* * * * *

UNITED STATES PATENT AND TRADEMARK OFFICE

CERTIFICATE OF CORRECTION

PATENT NO. : 5,125,707

DATED : June 30, 1992

INVENTOR(S) : CHAEN et al

It is certified that error appears in the above-identified patent and that said Letters Patent is hereby corrected as shown below:

On the title page, Item [75], second line, the city of residence for Yoshinobu Chaen should read --Sakai-shi, Japan--.

Signed and Sealed this

Twentieth Day of July, 1993

*Attest:*

Michael K. Kirk

MICHAEL K. KIRK

*Attesting Officer*

*Acting Commissioner of Patents and Trademarks*